United States Patent [19]

Degeneff et al.

[11] 4,318,066

[45] Mar. 2, 1982

[54] EXTERNALLY SHIELDED DISK WINDINGS FOR TRANSFORMERS

[75] Inventors: Robert C. Degeneff; William N. Kennedy, both of Pittsfield, Mass.

[73] Assignee: General Electric Company

[21] Appl. No.: 151,189

[22] Filed: May 19, 1980

[51] Int. Cl.[3] ..... H01F 15/04

[52] U.S. Cl. ..... 336/70; 336/84 C; 336/187

[58] Field of Search ..... 336/84 R, 84 C, 69, 336/70, 186, 187

[56] References Cited

U.S. PATENT DOCUMENTS

| | | | |
|---|---|---|---|
| 2,220,539 | 11/1940 | Pavou et al. | 336/70 |
| 2,279,027 | 4/1942 | Weed et al. | 336/70 |
| 2,279,028 | 4/1942 | Weed | 336/70 |
| 3,106,690 | 10/1963 | Angermeyer | 336/70 |
| 4,084,144 | 4/1978 | Weniger | 336/70 |

FOREIGN PATENT DOCUMENTS

| | | | |
|---|---|---|---|
| 222165 | 6/1942 | Switzerland | 336/70 |
| 551968 | 3/1943 | United Kingdom | 336/70 |
| 634379 | 3/1950 | United Kingdom | 336/70 |

*Primary Examiner*—Thomas J. Kozma
*Attorney, Agent, or Firm*—Robert A. Cahill

[57] ABSTRACT

A disk wound transformer winding employing at least two external electrostatic shields extending axially along the outside of the disk winding for grading the impulse voltage within the winding. The inner external shield closest to the winding is connected to the line terminal and the outer external shield is connected to ground. A substantially linear voltage gradient under impulse conditions is attained by the combination of a disk winding arrangement and a specifically tailored assembly of external shields extending along the outside of the winding.

12 Claims, 6 Drawing Figures

13
14
16
17
18
19
8
16A
7
16B
16C
20
23
10
22
23
21
16N
15
11
11
12
9

EXTERNALLY SHIELDED DISK WINDINGS FOR TRANSFORMERS

BACKGROUND OF THE INVENTION

This invention relates to transformers having disk type windings with improved impulse voltage gradients similar to those disclosed within U.S. Pats. Nos. 2,279,028 and 3,387,243.

It is well known that highly inductive windings such as those employed in iron core transformers and reactors when exposed to steep wavefront impulse or transient voltages, initially exhibit an exponential distribution of voltages along the length of the windings with a very high voltage gradient at the first few turns. For example, approximately 60% of the voltage may appear across the first 5% of the turns of the winding at the high voltage end. This extremely nonuniform distribution of voltage is due primarily to the unavoidable distributed capacitance between each incremental part of the winding and adjacent grounded structure such as the core and the casing. Such ground capacitance is referred to as "parallel" capacitance when the low voltage end of the winding is grounded in the usual manner. The winding also inherently contains a distributed capacitance between the turns and between the winding sections. The effective sum of all the distributed capacitances between turns and sections associated with a particular disc winding arrangement results in a value of capacitance in series with the winding terminals. If this "series" capacitance alone were present, voltage distribution throughout the winding would be substantially uniform and linear. This would occur also if inductance alone were present. However, since both series and parallel distributed capacitances are inherent winding characteristics, the transient voltage distribution is a design consideration of importance.

U.S. Pat. Nos. 2,279,028 and 3,387,243 attempt to circumvent the nonuniform transient voltage distribution of a disk winding by supplying supplemental ground capacitance charging current which would otherwise flow through the series capacitance network of the disk winding.

Aforementioned U.S. Pat. No. 2,279,028 discloses a static plate arranged at the line end of the winding and electrically connected both to the line voltage lead and to a plurality of rib type external shields. The rib shields consist of a single turn each of electrically insulated wire arranged radially around the winding with the static plate located axially adjacent to the first winding section. The rib shields are arranged opposite the second winding section and extend axially along a portion of the remainder of the winding. When inner and outer rib shields are employed, the outer shields are electrically insulated from the inner shields so that the individual rib shields are electrostatically coupled rather than electrically connected. By providing the external rib shield network, a large portion of ground capacitance charging current flows through the external rib shields and not through the series capacitance network of the winding.

Aforementioned U.S. Pat. No. 3,387,243 utilizes a pair of upper and lower static plates to supply charging current which does not flow through the series capacitance of the disk winding and thereby improves the voltage gradient during impulse conditions. The upper static plate is arranged parallel to the turns that comprise the first disk winding section and only the first portion of the winding sections adjacent to the line voltage lead contain interleaved turns. The voltage gradient is substantially modified along the disk sections closest to the line end of the winding. The purpose of the lower static plate within the continuous portions of the winding sections is to decrease the large impulse transient voltage gradient which occurs between the interleaved disk sections near the line end of the winding and the continuous disk sections further along the winding. Although the voltage gradient under impulse conditions is improved by the static plates, they are not applicable to all disk winding configurations, and may simply transfer the large impulse transient voltage gradient problem from the area where the interleaved sections join the continuous disk sections to the area within the continuous disks just below the lower static plate.

The purpose of this invention is to provide a disk winding arrangement having a voltage gradient along the winding under impulse conditions which is nearly the same as the turns ratio voltage gradient.

SUMMARY OF THE INVENTION

The invention comprises a plurality of disk winding sections arranged around a core and including at least two radially arranged cylindrical electrostatic shields outside the disk winding. The external shield closest to the winding is connected to the line voltage lead and the external shield furthest from the winding is solidly grounded. One embodiment includes the addition of at least one further cylindrical electrostatic shield positioned between the line and ground shields and electrically insulated therefrom. A further embodiment includes the additive combination of external cylindrical shields and any of the known methods for increasing series capacitance.

DESCRIPTION OF THE PREFERRED EMBODIMENT

Figure 1:
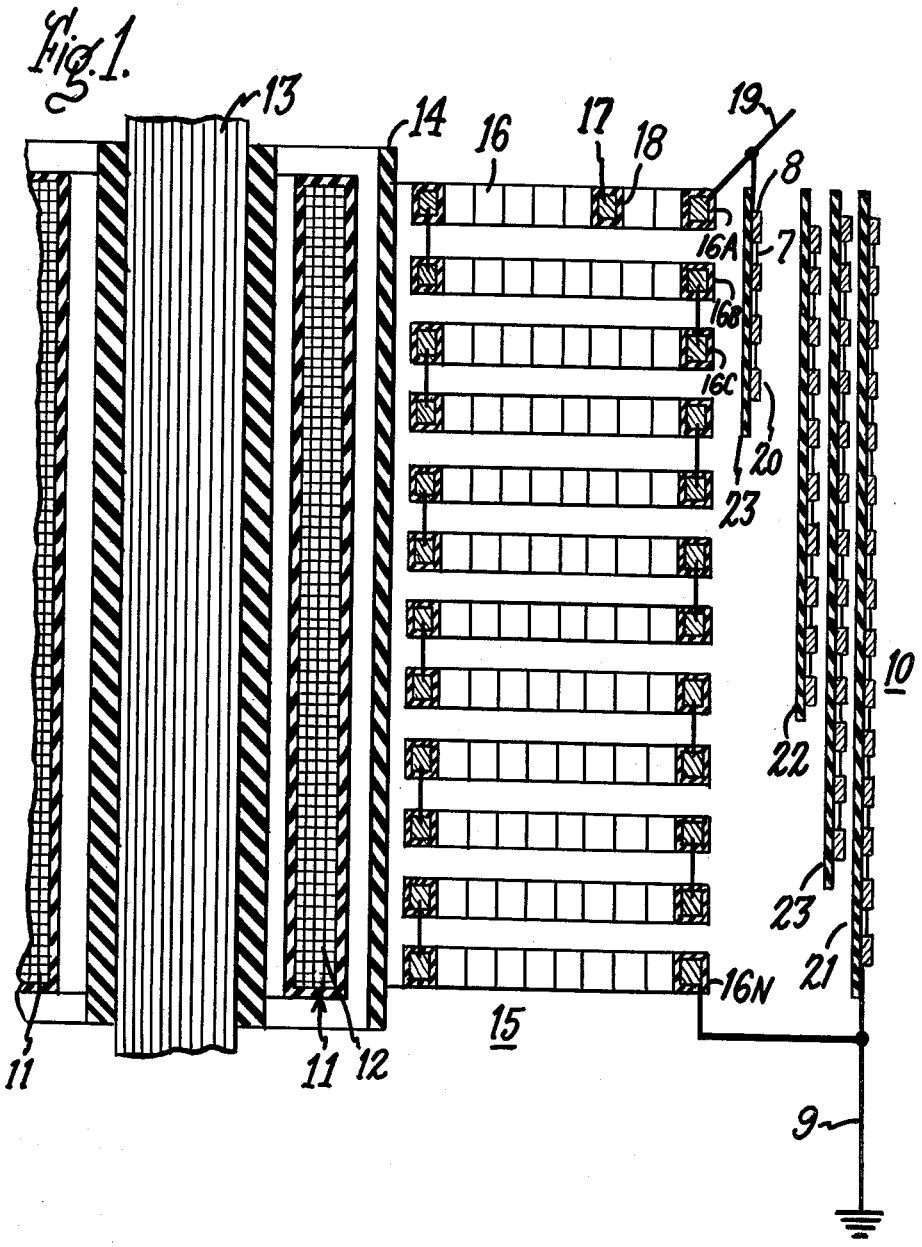
FIG. 1 is a sectional view of a disk winding having cylindrical external shields according to the invention.

A transformer having the disk winding arrangement of the invention can be seen by referring to FIG. 1 wherein winding arrangement 10 consisting of a low voltage winding 11 containing a plurality of insulated wire turns 12 is arranged around a transformer core 13 where main gap insulation 14 separates high voltage disk winding 15 from low voltage winding 11. Low voltage winding 11 is arranged in a barrel type winding arrangement wherein the individual wire turns 12 are continuously wound in a spiral around transformer core 13. Winding 15 which can also be arranged as a line in center disk winding, consists of a plurality of disk sections 16, each disk section comprises a plurality of wire turns 17 progressing radially outward around core 13 in a pancake configuration. Each wire turn 17 has an insulating coating 18 in order to prevent short circuits from occurring between individual turns. Disk winding sections 16 are arranged in a plurality of individual sections 16A–16N, wherein the first section 16A is connected to line lead 19 and last disk section 16N is connected to ground lead 9. Also connected to line lead 19 is a first cylindrical external electrostatic shield assembly 20 which is innermost, that is, radially closest to winding 15. Also connected to ground lead 9 is a second cylindrical external electrostatic shield assembly 21 outermost to, that is, radially most distant from winding 15. First external electrostatic shield assembly 20 extends axially along disk winding 15 for some fraction of the winding length which depends upon the geometry of the particular disk winding 15. Second external electrostatic shield assembly 21 extends for approximately the entire length of disk winding 15. The construction of the electrostatic shield assembly 20 can be quite varied since the purpose of the shields is to electrostatically shield the winding completely in the radial direction and for only a specified dimension in the axial direction. In an effort to reduce electromagnetically induced eddy losses in the external shield structure and in view of practical economic considerations, the arrangement of assembly 20 may vary from application to application. One example is such that the first external electrostatic shield assembly 20 comprises a wrapping of insulating paper 23 containing a plurality of continuous metal bands or strips 8 measuring approximately two inches high by 0.002 inch thick. The individual metal strips 8 are electrically interconnected strip to strip by means of a thin metallic conductor 7 but do not electrically form a closed loop. This assures that the individual metal strips 8 will be at approximately the same electrostatic potential. Metal strips 8 are made thin to reduce losses caused by eddy current effects. A third external electrostaic shield 22 is situated intermediate first shield 20 and second shield 21 extends axially along winding 15 a greater distance than first shield 20 and a lesser distance than second shield 21. A fourth external electrostatic shield 23 is situated intermediate second shield 21 and third shield 22 and extends axially along winding 15 a greater distance than third shield 22 and a less distance than second shield 21.

In some disk winding arrangements, the last disk section 16N may not be connected solidly to ground but electrically connected to another winding such as an additional disk winding, layer winding, or even a tap winding. In these applications the last disk section 16N is electrically connected to one of the intermediate external electrostaic shields (22,23) such that the impulse voltage distribution which occurs at the point of connection with the intermediate shield (22,23) is nearly the same as the turns ratio voltage at that point. The turns ratio voltage is defined as the voltage at a point P such that the ratio $V_T/N_T=V_P/N_P$ where $V_T$ is the voltage at the line terminal, $N_T$ is the total nubmer of turns in the winding, $V_P$ is the voltage at any point P, and $N_P$ is the number of turns from ground to point P.

It is to be clearly understood that the first external electrostatic shield 20, which is electrically connected to line, must be closest to the disk winding 15 and extend down the winding the shortest distance of all the external electrostatic shields. The second external electrostatic shield 21 which is solidly connected to ground, must be the furthest external electrostatic shield from disk winding 15 and extend the full axial length of disk winding 15. All other intermediate external electrostatic shields such as 22 and 23, are physically located between first shield 20 and second shield 21 and extend in increasing lengths axially along disk winding 15 from first electrostatic shield 20 to second electrostatic shield 21 in an orderly fashion. The number of intermediate external electrostatic shields employed can vary from zero to a large number depending upon the electrical properties desired and the economic factors of the specific winding design.

The specific radial location of external electrostatic shield 20 relative to winding 15, of external electrostatic shield 21 to shield 20, and additional external electrostatic shields 22 and 23, if required, is a complex and interrelated problem. The selection of the number of external electrostatic shields employed, their radial spacing and vertical extent must be determined iteratively by using sophisticated computer program. The criteria for selecting the best arrangement of external electrostatic shields includes a comparison of voltage to ground at a point in the winding further impulse, to the corresponding turns ratio voltage. It also includes comparing the voltage gradient at a point in the winding to the turns ratio gradient at that point due to the turns ratio voltage. Additionally, the various voltage stresses from points in the shield assembly, within the winding and within the shield structure itself are compared to the physical withstand stresses of the structural materials employed within the winding structure.

When the bottommost disk section 16N is not connected to ground but to another winding, the intermediate external electrostatic shield 23 immediately adjacent grounded second external electrostatic shield 21 will also extend the full length of the disk winding 15. The physical placement, electrical connections, number of external shields and axial extent of the external electrostatic shields 20–23, which provide supplementary ground capacitance charging current outside winding 15 will in each case be dictated by the winding configuration itself and economic tradeoffs.

Figure 2:
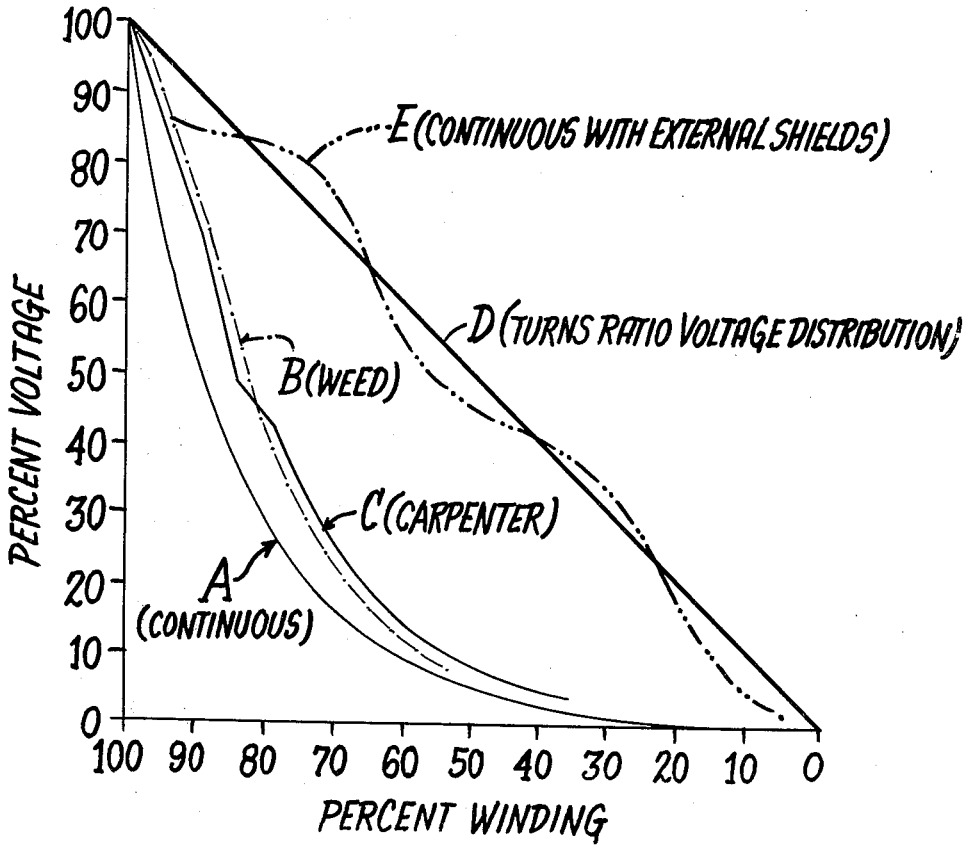
FIG. 2 is a graphic representation of the voltage to ground along the disk winding of FIG. 1 for various winding arrangements.

FIG. 2 describes the per cent voltage to ground as a function of the per cent of the winding turns for the initial distribution of an impulse voltage across disk winding 15. The well-known voltage gradient for a continuous winding under impulse conditions, is shown at A. A continuous disk winding is defined herein as a winding wherein the winding turns 17 are sequentially arranged with a section 16 from a single wire conductor and wherein the first coil section 16A is electrically connected with subsequent individual winding sections 16B–16N in a sequential manner. The voltage gradient under impulse conditions for the aforementioned U.S. Pat. No. 2,279,028 containing rib shields is shown at B for comparison purposes. The voltage gradient under impulse conditions for the partially interlaced disk winding described within aforementioned U.S. Pat. No. 3,387,243 containing static plates is shown at C, and the ideal linear voltage gradient condition is shown at D. The voltage gradient for the embodiment depicted in FIG. 1 and consisting of first external electrostatic shield 20 connected to line lead 19, second external electrostatic shield 21 connected to ground lead 9, third external electrostatic shield 22, and fourth external electrostatic shield 23 relative to continuous disk winding 15 is depicted at E in FIG. 2. It can be seen that this embodiment improves over the prior art devices by more nearly approaching the ideal curve shown at D.

Figure 3:
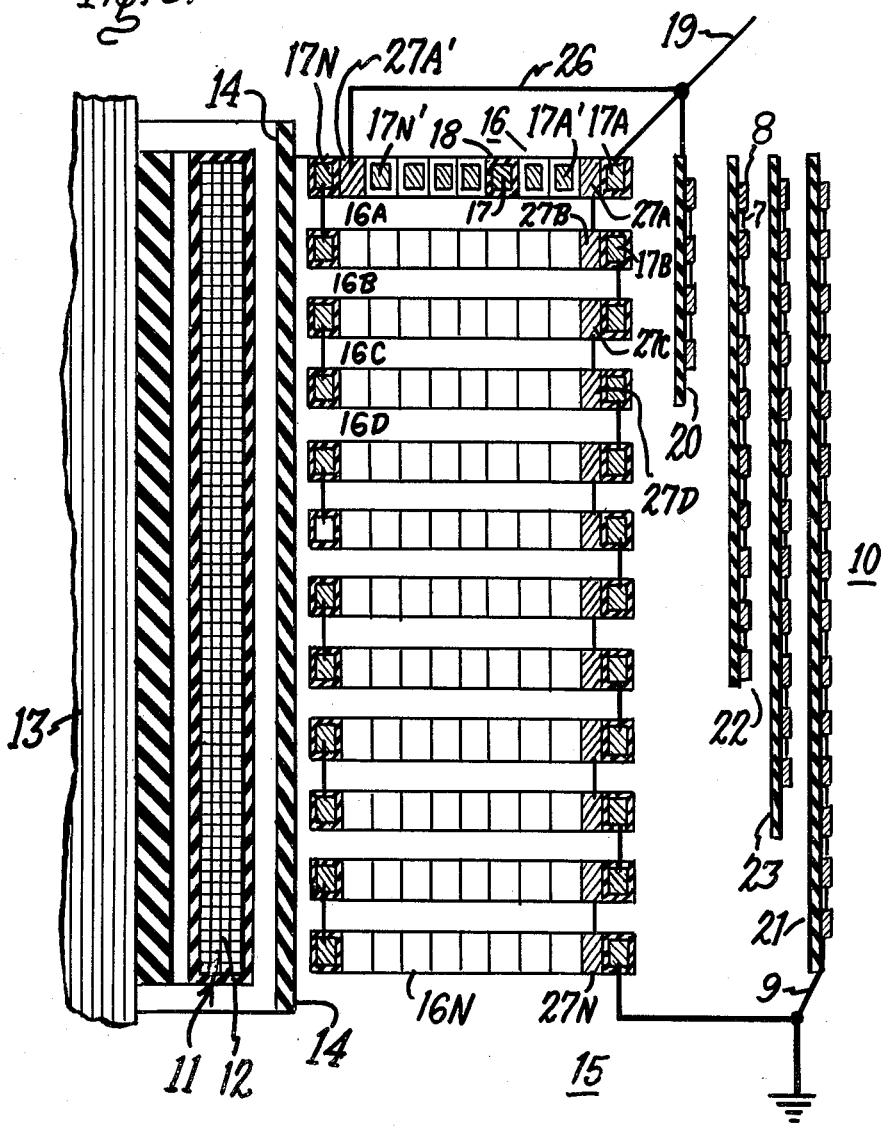
FIG. 3 is a sectional view of a disk winding containing internal shields in combination with the cylindrical external shields of the invention.
Figure 4:
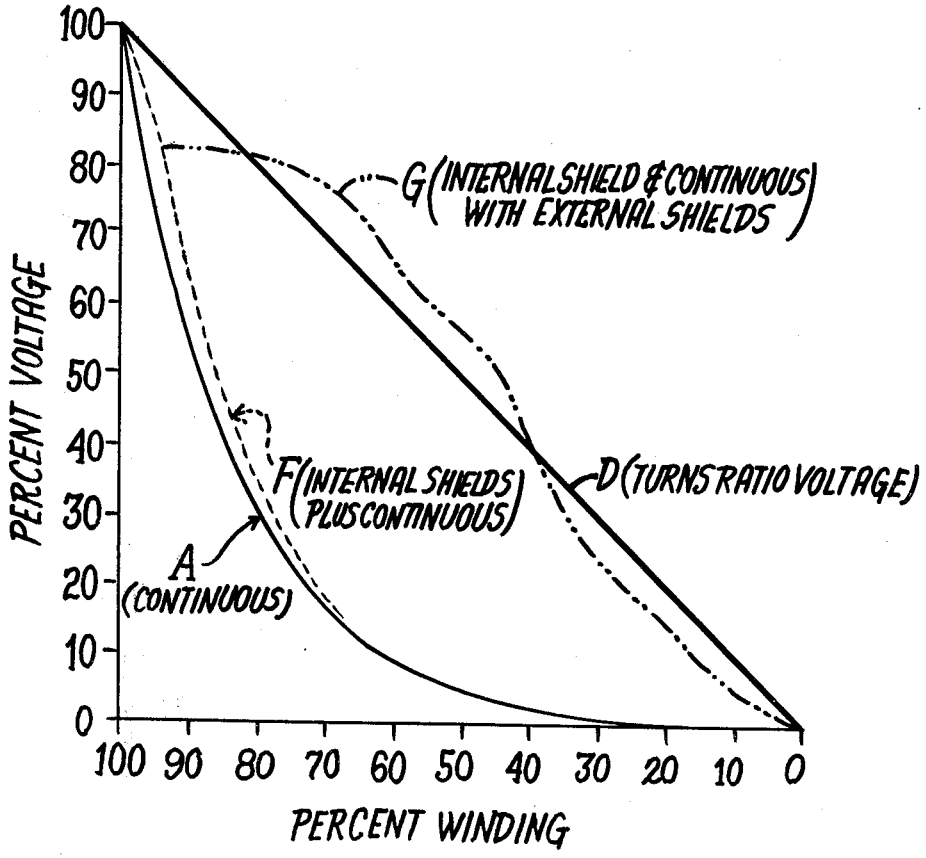
FIG. 4 is a graphic representation of the voltage gradient along the disk winding of FIG. 3.

FIG. 3 contains a disk winding arrangement wherein the disk winding voltage gradient is made more nearly linear than for the internal shields disclosed within the prior art. In this winding arrangement low voltage winding 11 is arranged around core 13 and is separated from disk winding 15 by means of main gap insulation 14. FIG. 3 shows how the present invention improves the linearity of voltage distribution achieved by internal shields alone. Disk winding 15 comprises a plurality of disk sections 16 arranged in a pancake configuration wherein first section 16A is situated at the top and the last section 16N is located at the bottom of winding 15. A plurality of internal shields 27A–27N, each consisting of a single turn of an electrical conductor insulated from turns 17, is positioned between outermost turn 17A and the next outermost turn 17A'. A second internal shield 27B is located within second winding section 16B, between outermost turn 17B and the next outermost turn 17B'. Internal shields 27A and 27B are electrically connected together but are electrically insulted from wire turns 17. A second internal shield 27A' is situated within first winding section 16A, between the innermost turn 17N and the next innermost turn 17N'. Second internal shield 27A' is electrically connected to line lead 19 by means of connector 26. Second internal shield 27A' is electrically connected to outermost turn 17A as well as to first external electrostatic shield 20. Adjacent pairs of disk sections 16C and 16D also contain internal shields 27C and 27D electrically connected in a manner similar to that described earlier for internal shields 27A and 27B. Disk winding arrangement 10 also contains a second external electrostatic shield 21 connected to ground by means of ground lead 9 and third and fourth electrostatic shields 22, 23 which are electrically insulated from first and second external electrostatic shields 20, 21 similar to the winding arrangement described earlier in FIG. 1. The addition of internal shields 27A to 27N improves the voltage gradient during impulse conditions along disk winding 15 by further increasing the series capacitance within winding sections 16A–16N. The improved voltage gradient which occurs with the addition of internal shields 27A–27N can be seen by referring to FIG. 4. The voltage gradient expressed in per cent voltage as a function of the per cent of the winding turns for a continuous disk winding wherein the wire turns 16 are provided from a continuous electrical conductor is shown at A for comparison purposes. The improvement in voltage gradient with the addition of internal shield 27A–27N is shown at F. The voltage for the winding arrangement 10 of FIG. 3 including internal shields 27A–27N and external electrostatic shields 20, 21, 22 and 23 is shown at G. FIG. 4 therefore shows an improvement in the voltage gradient along disk windings by the combination of internal shields and external electrostatic shields.

Figure 5:
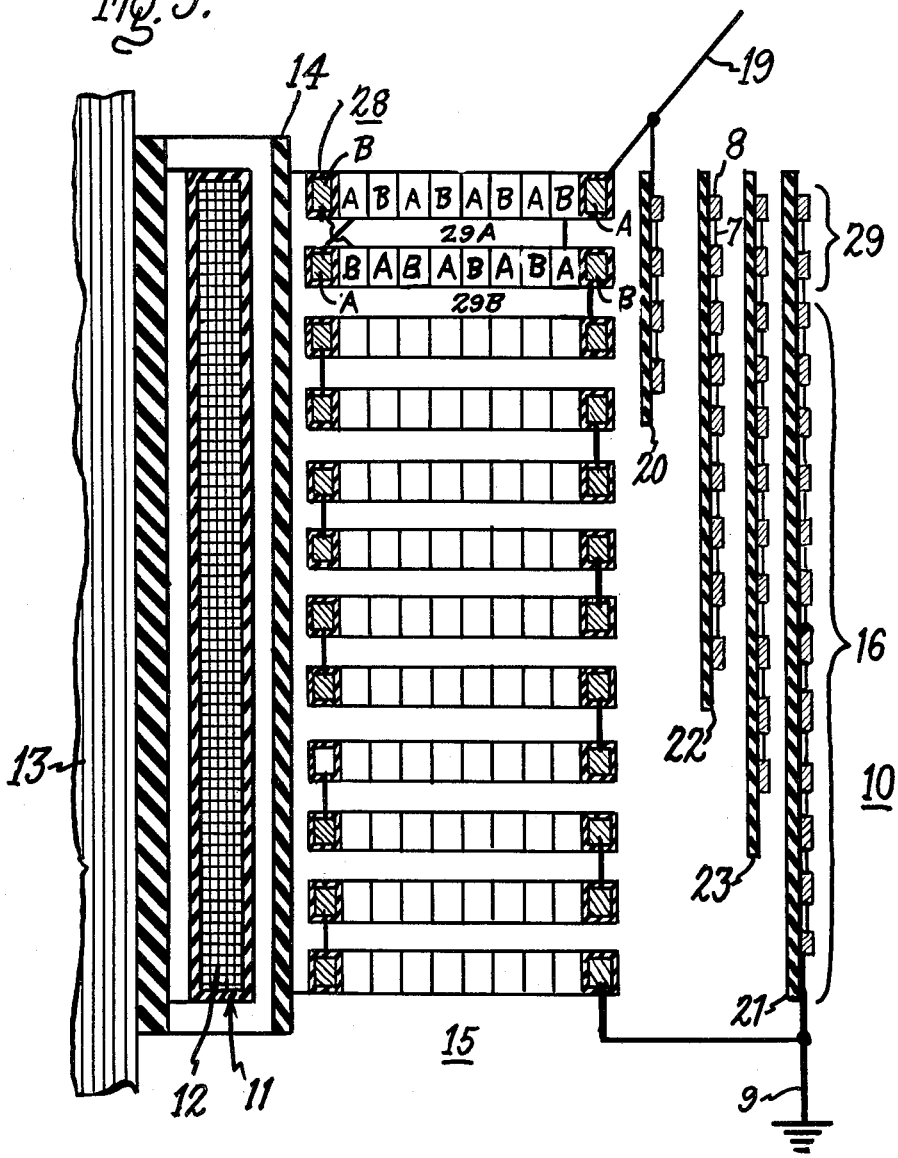
FIG. 5 is a sectional view of a disk winding with some of the sections having interleaved turns in combination with the cylindrical external shields of the invention.

FIG. 5 contains another disk winding arrangement 10 wherein low voltage coil 11 surrounds transformer core 13 and is separated from disk winding 15 by means of main gap insulation 14. Disk winding 15 contains a plurality of disk wound sections 16 arranged similar to the embodiments shown earlier in FIGS. 1 and 3 except for the first two winding sections now referred to as 29A and 29B. These first two winding sections 29A, 29B contain a plurality of interleaved wire turns 28 which are formed from a pair of conductors referred to hereafter as conductor A and conductor B. Since the first two sections 29A and 29B contain a plurality of turns 28 which are arranged by interleaving the pair of conductors A and B, a different reference numeral is employed to distinguish the interleaved wire 28 from the continuous winding turns 17A–17N used within the continuous turn disk winding sections 16 of FIGS. 1 and 3. Interleaving the conductors A, B in the first two sections 29A and 29B substantially increases the effective series capacitance of the first two sections. This is necessary because under impulse conditions, a substantial amount of the impulse voltage appears across the first two winding sections 29A and 29B. First external electrostatic shield 20 is electrically connected to line lead 19 and to outer turn A' in first winding section 29A.

Figure 6:
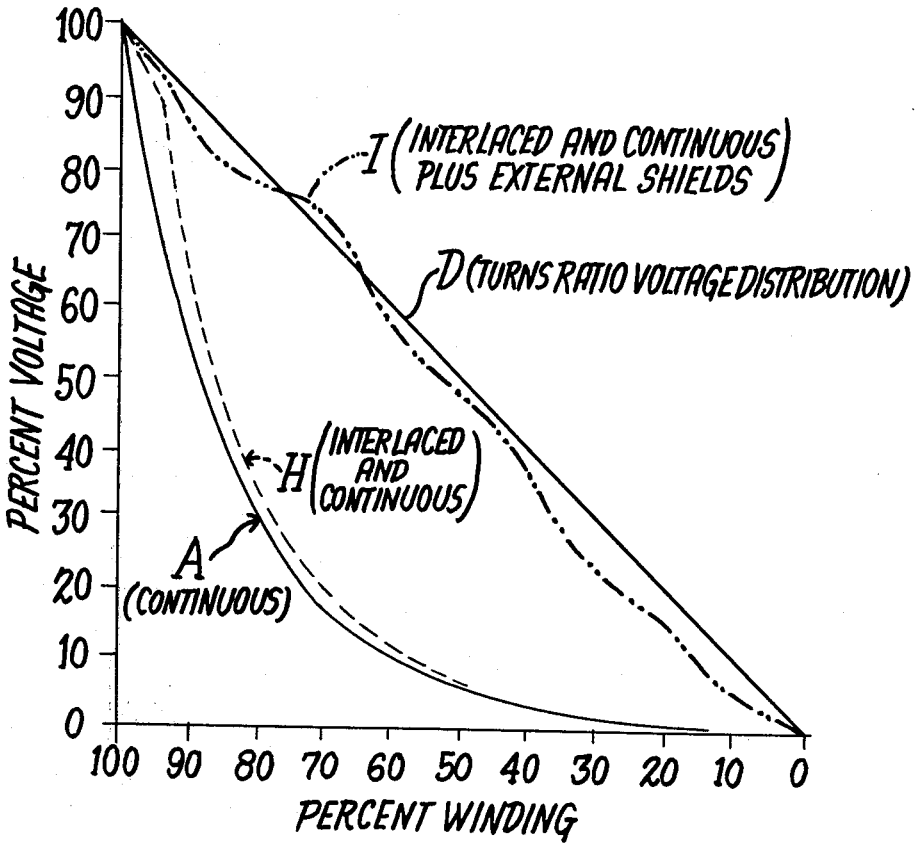
FIG. 6 is a graphic representation of the voltage gradient along the disk winding shown in FIG. 5.

The voltage gradient for the winding arrangement 10 of FIG. 5 is expressed in terms of voltage per cent as a function of per cent wnding turns and is shown in FIG. 6. The voltage gradient for a combined interlaced and continuous winding with no external shields is shown at H. The voltage gradient for the combined interlaced and continuous winding containing four external shields 20–23 is shown at I.

FIG. 6 shows that voltage gradients occurring across disk windings under impulse conditions can be carefully tailored to approximate the turns ratio voltage that occurs across the windings under normal operating conditions. Increasing the series capacitance of the disk winding by internal shields, interleaving, static plates or other winding arrangements does not, per se, completely correct the distorted voltage gradient that occurs under impulse.

Another method often employed for increasing the series capacitance of disk windings is to connect the individual coil sections in a nonsequential manner rather than in a continuous sequence as indicated in FIGS. 1, 3 and 5. The nonsequential arrangement wherein the first section is not connected with the second section but connects with the third section, for example, substantially increases the series capacitance within the disk winding. It is within the scope of this invention to use the external electrostatic shields shown in FIGS. 1, 3 and 5 with nonsequential disk windings.

What is claimed as new and which it is desired to secure by Letters Patent of the United States is:

1. A transformer comprising:

a core;

a first winding arranged around said core;

a disk winding having a ground capacitance surrounding said first winding and consisting of a plurality of wire turns axially arranged along said core in a plurality of winding sections;

at least first and second external electrostatic shields extending along the opposite side of said disk winding from said core, said first shield being an innermost shield connected with a line lead an disposed adjacent the line end of said disk winding, and said second shield being an outermost shield connected to a ground lead and disposed along substantially the full axial length of said disk winding for providing additional charging currents to said disk winding ground capacitance to improve transient voltage distribution along said disk winding.

2. The transformer of claim 1 wherein said wire turns are arranged in a predetermined sequence extending radially outward from said core from an inner turn proximate said core to an outer turn distal from said core.

3. The transformer of claim 2 wherein said disk sections are arranged in a plurality of series connected section pairs and wherein said wire turns within at least two of said section pairs comprise a pair of first and second wire conductors arranged in an interleaved pattern.

4. The transformer of claim 2 wherein said wire sections include at least one internal electric shield within said disk winding.

5. The transformer of claim 1 further including a third shield intermediate said first and second external shields and electrically insulated from said first and said second shields.

6. The transformer of claim 1 wherein said first shield is proximate said disk winding and said second shield is located at a further radial distance from said disk winding, said first shield extending a shorter axial distance than said second shield along said disk winding.

7. The transformer of claim 1 wherein said first and second shields both comprise a wrapping of paper insulation containing a plurality of horizontal metal strips on the surface of said paper and arranged vertically along said disk winding, said metal strips being electrically connected together.

8. The transformer of claim 5 wherein said third shield extends a greater axial distance along said disk winding than said first shield and a lesser axial distance than said second shield.

9. The transformer of claim 5 further including a fourth shield intermediate said first and said third shield, said fourth shield extending a greater axial distance along said disk winding than said first shield and extending a lesser axial distance along said disk winding than said third shield, said fourth shield being electrically insulated from said first, second, and third shields.

10. The transformer of claim 2 wherein at least two of said disk sections are connected in a nonsequential arrangement wherein one of said disk sections is not directly connected with an adjacent one of said disk sections.

11. The transformer of claim 4 wherein said internal shield is electrically connected with said line lead.

12. A reactor comprising:

a core;

a disk winding having a capacitance to ground arranged around said core and consisting of a plurality of wire turns axially arranged along said core in a plurality of winding sections;

at least first and second external electrostatic shields extending along the opposite side of said disk winding from said core, said first shield being an innermost shield connected with a line lead and disposed adjacent the line end of said disk winding, and said second shield being an outermost shield connected to a ground lead and disposed along substantially the full axial length of said disk winding for providing additional charging currents to said disk winding ground capacitance to improve transient voltage distribution along said disk winding.

* * * * *